United States Patent [19]

Tadama

[11] Patent Number: 5,030,963

[45] Date of Patent: Jul. 9, 1991

[54] SIGNAL RECEIVER

[75] Inventor: Motomu Tadama, Kanagawa, Japan

[73] Assignee: Sony Corporation, Tokyo, Japan

[21] Appl. No.: 392,359

[22] Filed: Aug. 11, 1989

[30] Foreign Application Priority Data

Aug. 22, 1988 [JP] Japan ..... 63-207837

[51] Int. Cl.[5] ..... H01Q 1/24

[52] U.S. Cl. ..... 343/702; 343/859; 455/300

[58] Field of Search ..... 343/702, 859, 741, 841, 343/722, 729; 455/271, 292, 295, 282–284, 278, 279, 300

[56] References Cited

U.S. PATENT DOCUMENTS

| | | | |
|---|---|---|---|
| 2,218,083 | 10/1940 | Carlson et al. | 343/846 |
| 3,122,746 | 2/1964 | Leonard | 343/859 |
| 3,530,473 | 9/1970 | Ives | 343/702 |
| 3,573,628 | 4/1971 | Cramer et al. | 343/702 |
| 3,611,198 | 10/1971 | Ma | 455/284 |
| 4,173,742 | 11/1979 | Lehmann | 455/292 |

FOREIGN PATENT DOCUMENTS

| | | | |
|---|---|---|---|
| 361807 | 8/1938 | Italy | 343/859 |

*Primary Examiner*—Michael C. Wimer

*Attorney, Agent, or Firm*—Hill, Van Santen, Steadman & Simpson

[57] ABSTRACT

A signal receiver with a cabinet and mono-pole antenna mounted outside of the cabinet with a signal receiving apparatus mounted inside of the cabinet. A shielded conductor is mounted inside of the cabinet as another antenna to be used with the mono-pole antenna. A balun which has first and second input terminals and an output terminal, and the first and second input terminals of the balun are connected to the mono-pole antenna and to the shield conductor and the output terminal is connected to the signal receiving apparatus.

4 Claims, 6 Drawing Sheets

SIGNAL RECEIVER

BACKGROUND OF THE INVENTION

1. Field of the Invention

The present invention relates generally to signal receivers and more particularly to a signal receiver which has a mono-pole antenna.

2. Description of the Prior Art

FIG. 1 shows an example of a prior-art doublet antenna (or dipole antenna) type signal receiver.

The doublet antenna type signal receiver of FIG. 1 is provided with a cabinet 1 made of a plastic material and with rod antennas 2 and 3. The rod antennas 2 and 3 are connected through a balun 4 to a tuner (not shown) which is provided inside of the cabinet 1.

FIG. 2 is an equivalent circuit of the doublet antenna type signal receiver shown in FIG. 1. The antennas 2 and 3 are connected through the balun 4 to an input impedance R of a tuner. Within the cabinet 1, there exists disturbing noise sources such as a microcomputer, a switching source, various digital circuits or the like which generate electrical fields hereinafter referred to as an electric field disturbing signal sources and signal disturbing sources which generate magnetic fields (hereinafter referred to as magnetic disturbing signal sources). The disturbing signal sources are represented by $e_1$ and $e_2$ in FIG. 2.

FIG. 3 shows the distributions of the electric fields produced by the electric field disturbing signal source $e_1$ and also shows the magnetic field produced by the magnetic field disturbing signal source $e_2$. Although a small disturbing current flows through the tuner which is generated by the disturbing signal sources $e_1$ and $e_2$, since there is no disturbing signal source $e_3$ (see FIGS. 4 and 5) which is caused by a voltage drop which is generated by a current which flows through an earth or ground pattern such as an inside circuit which will be described later, the disturbance is very small.

Although the above-mentioned doublet antenna type signal receiver does not pick up its own disturbance very easily, it needs two rod antennas 2 and 3 to operate and this is inconvenient and is a disadvantage for a compact-sized signal receiver.

FIG. 4 shows an example of a prior-art mono-pole antenna type signal receiver which has a mono-pole or single rod antenna which removes the defects encountered with the doublet antenna type signal receiver shown in FIG. 1.

FIG. 4 shows a cabinet 5 made of a plastic material, a rod antenna 6 and an earth or ground pattern 7 which connects an earth portion of, for example, a printed circuit board and one portion of a metal chassis to ground. As shown in FIG. 4, the earth pattern 7 is used as one antenna which is opposed to the rod antenna 6 which is the mono-pole antenna, and a terminal E of the earth pattern 7 and a terminal P of the rod antenna 6 are connected to a tuner which is included in a circuit portion 8.

FIG. 5A shows an equivalent circuit of FIG. 4 which includes another disturbing signal source $e_3$ in addition to the disturbing signal sources $e_1$ and $e_2$ because the earth pattern 7 is used as one of the antenna.

FIG. 5B shows a substantial equivalent circuit of the electromotive forces $e_1'$, $e_2'$ and $e_3'$ which correspond to the respective disturbing signal sources $e_1$, $e_2$ and $e_3$ and in which $e_1'$ represents an equivalent electromotive force formed by the electrostatic coupling between the earth pattern 7 and the magnetic field disturbing signal source $e_1$. $e_2'$ represents an electromotive force of the magnetic field which is induced in the earth pattern 7 by the magnetic field disturbing signal source $e_2$, and $e_3'$ represents a voltage drop caused by the current flowing through one portion between I and J (see FIG. 4) of the earth pattern 7. The voltage drop $e_3'$ is the disturbing electromotive force which is produced in series in the earth pattern 7.

FIG. 5C is a diagram of an equivalent circuit which illustrates the electromotive forces corresponding to the respective disturbing signal sources. In FIG. 5C, e is expressed as $e=e_1'+e_2'+e_3'$. FIG. 6 is a diagram of the distribution of electromotive forces (displacement currents) of the disturbing electric field which are generated by the disturbing signal source e.

In the case of the prior-art mono pole antenna type signal receiver shown in FIG. 4, described above, the disturbing signal sources $e_1$, $e_2$ and $e_3$ are equivalently connected in series to the earth pattern 7 which forms one of the antenna and the electromotive forces of the electric field are distributed as shown in FIG. 6 so that one portion of the displacement currents from the disturbing signal source e flows to the input impedance R of the tuner through the antennas 7 and 6. In other words, the electromagnetic field caused by the higher harmonic components produced from the digital circuit or the like mounted inside of the signal receiver is picked up by its own antenna so that the signal receiver is subjected to a disturbance which is so-called autointoxication. As a result, a beat interference occurs in a television picture which causes line flicker in the television picture and a beat interference occurs in an audio signal which causes the sound quality to be deteriorated. Further, these beat interferences cause the synchronization relationship to be broken so that the signal receiver malfunctions

OBJECTS AND SUMMARY OF THE INVENTION

It is a general object of the present invention to provide an improved signal receiver which removes the above-mentioned shortcomings inherent in the prior art.

More specifically, an object of the present invention is to provide a signal receiver which can prevent beat interference from occurring in a television picture and in an audio signal.

It is another object of the present invention to provide a signal receiver which can prevent malfunctions systems such as in asynchronous operation and the like.

According to an aspect of the present invention, there is provided a signal receiver comprising:

(a) a cabinet;

(b) a mono-pole antenna mounted outside of the cabinet;

(c) a signal receiving apparatus mounted inside of the cabinet (d) a shielding conductor provided inside of the cabinet;

(e) a balun which has first and second input terminals and an output terminal; and (f) circuit means for connecting the first and second input terminals of said balun to said mono-pole antenna and said shielding conductor, respectively, and for connecting the output terminal to said signal receiving apparatus.

According to another aspect of the present invention, there is provided a small-sized signal receiver comprising:

(1) a cabinet;

(2) a mono-pole antenna extending from the inner side to the outer side of the cabinet;

(3) a signal receiving apparatus provided inside the cabinet and including a high frequency signal source such as a digital circuit;

(4) a shielding conductor provided inside of the cabinet;

(5) a balun which has first and second input terminals and an output terminal; and (6) circuit means for connecting the first and second input terminals of the balun to the mono-pole antenna and the shielding conductor, respectively, and for connecting the output terminal to the signal receiving apparatus such that the mono-pole antenna and the shielding conductor operate as a dipole antenna.

These and other objects, features and advantages of the present invention will be apparent from the following detailed description of the preferred embodiments when read in conjunction with the accompanying drawings.

DETAILED DESCRIPTION OF PREFERRED EMBODIMENTS

The present invention will now be described in detail with reference to FIG. 7 to FIGS. 14A and 14B.

Figure 7:
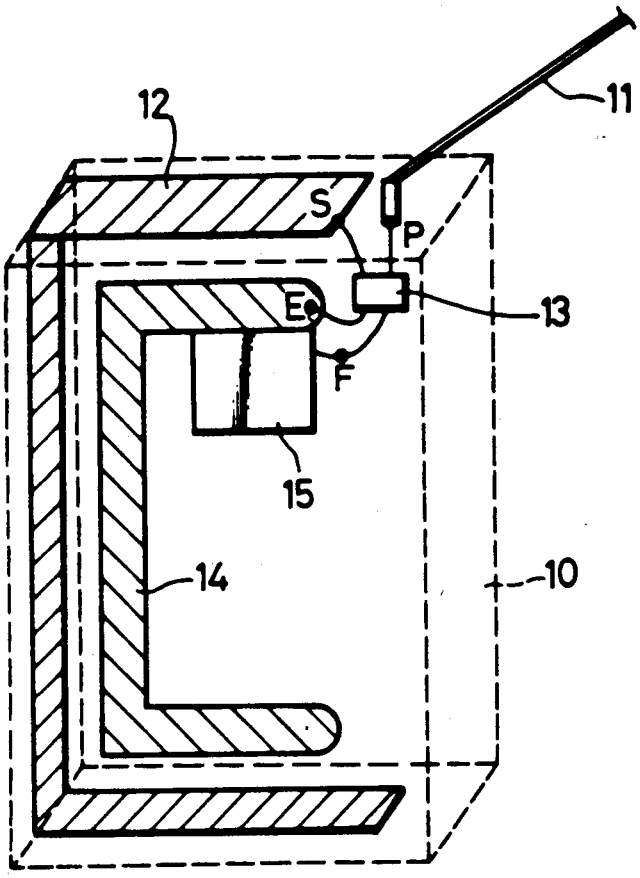
FIG. 7 is a schematic diagram showing an embodiment of a signal receiver according to the present invention.

FIG. 7 shows an embodiment of a signal receiver according to the present invention.

Referring to FIG. 7, an embodiment of the signal receiver according to the present invention is comprised of a cabinet 10, of plastic material. A rod antenna 11 is connected as a mono-pole antenna and U-shaped planar shielding conductor 12 is attached to one portion of the inner wall of the cabinet 10 and is insulated from a high frequency standpoint. A balun 13 is provided. An earth pattern 14 is U-shaped and is connected between a grounded portion of a printed circuit board and the metal chassis so that they are grounded. A tuner 15 is also provided in the signal receiving apparatus. The earth portion of the tuner 15 is connected to the earth pattern 14. Terminals P and S of the balun 13 are, respectively, connected to the antenna 11 and to the shielding conductor 12. Terminals E and F of the balun 13 are, respectively, connected to the tuner 15 and the earth pattern 14.

Figure 8:
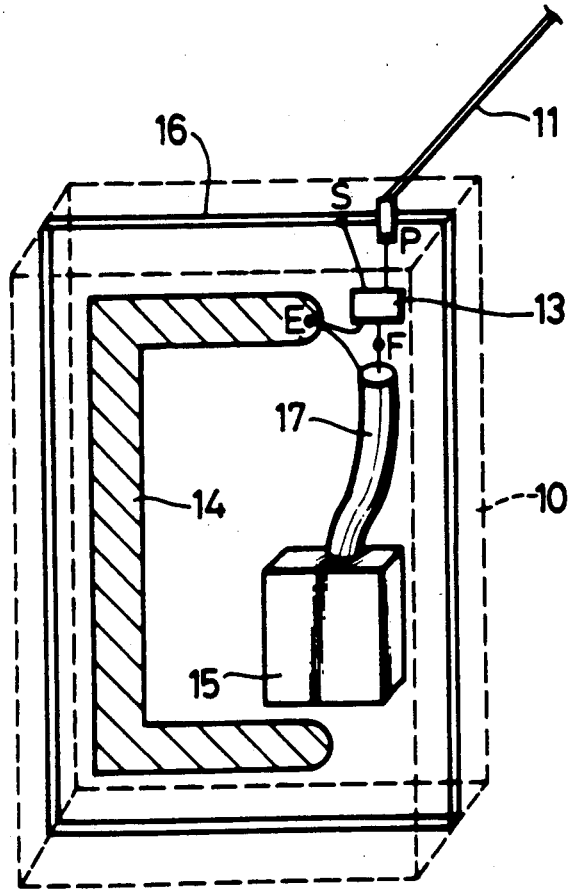
FIG. 8 is a schematic diagram showing another embodiment of a signal receiver according to the present invention.

FIG. 8 shows another embodiment of the signal receiver according to the present invention. In FIG. 8, parts which correspond to those of the FIG. 7 embodiment are marked with the same reference numerals and are not described in detail.

In this embodiment shown in FIG. 8, a thin loop-shaped planar conductor 16 is formed on the inner surface of the cabinet 10, and the terminal S of the balun 13 is connected to the shielding conductor 16. The terminal P of the balun 13 is connected to the antenna 11 and the terminal F is connected to a center conductor (hot end side) of a coaxial cable 17. The terminal E of the balun 13 is connected to the earth pattern 14 and is also connected to the outer sheath of the coaxial cable 17.

Figure 9A:
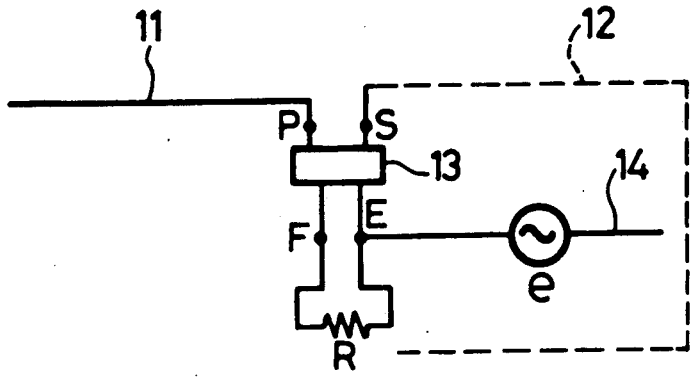
FIGS. 9A and 9B are schematic diagrams of the equivalent circuits of the circuits shown in FIGS. 7 and 8.
Figure 9B:
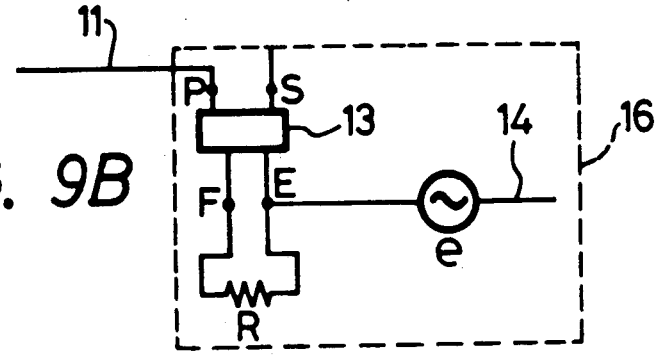
Figure 10:
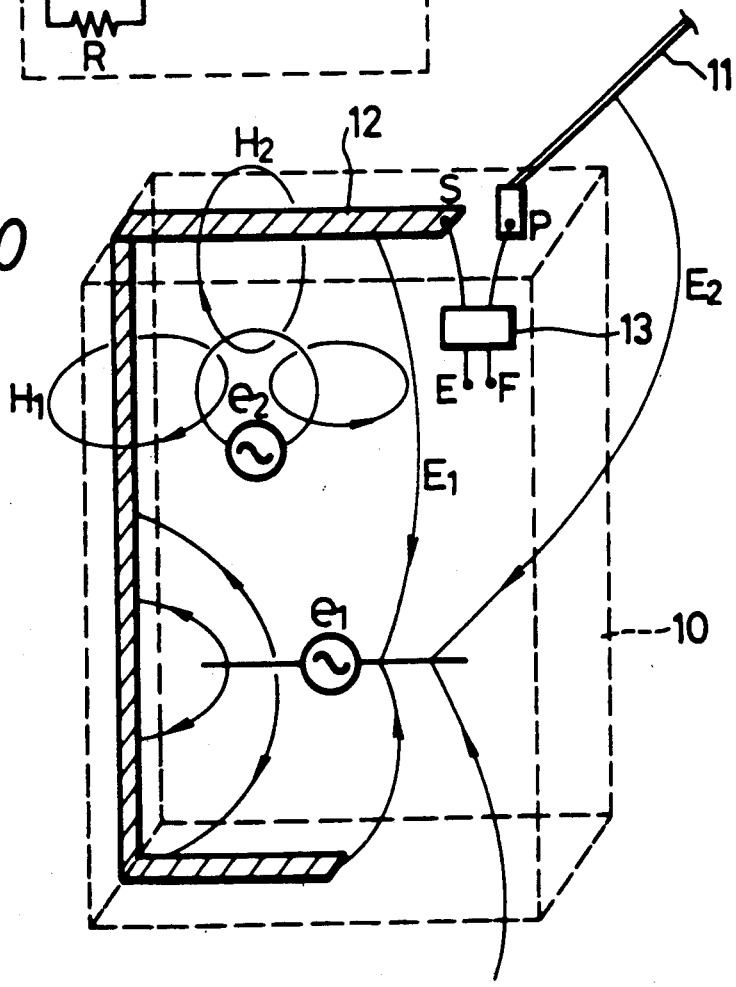
FIGS. 10 and 11 are schematic diagrams used to explain the operations of the signal receivers shown in FIGS. 7 and 8.

FIGS. 9A and 9B show the equivalent circuits of the devices shown in FIGS. 7 and 8. In FIGS. 9A the conductor 12 in FIG. 7 is represented as a U-shaped conductor which is connected to terminal S in FIG. 9. In FIG. 9B the conductor 16 in FIG. 8 is represented as a loop-shaped conductor 16 which is connected to the terminal S as shown in broken line in FIG. 9B.

Figure 1:
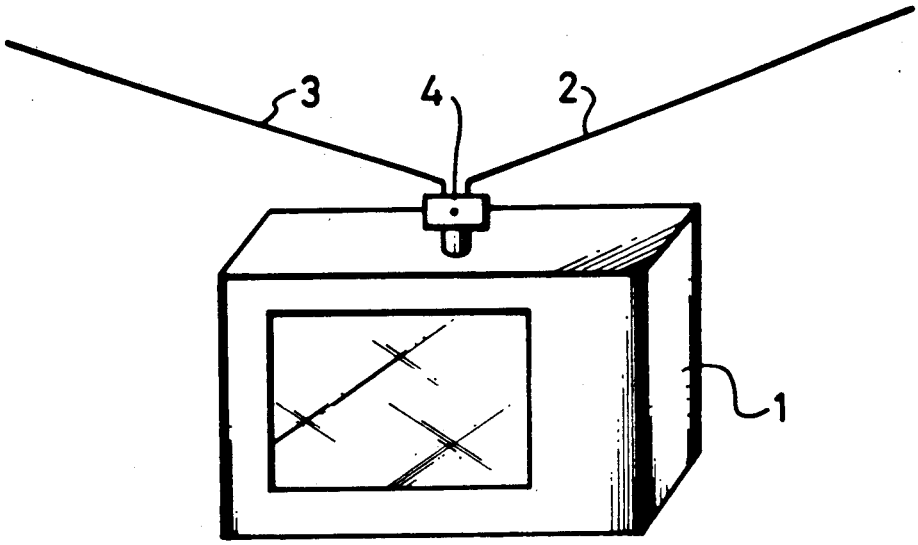
FIG. 1 (PRIOR ART)
FIG. 1 is a schematic diagram showing an example of a prior-art doublet antenna type signal receiver.
Figure 2:
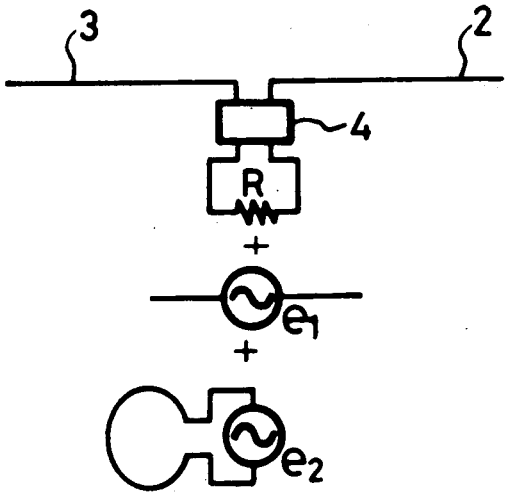
FIG. 2 (PRIOR ART)
FIG. 2 is a schematic diagram of an equivalent circuit of the receiver of FIG. 1.
Figure 3:
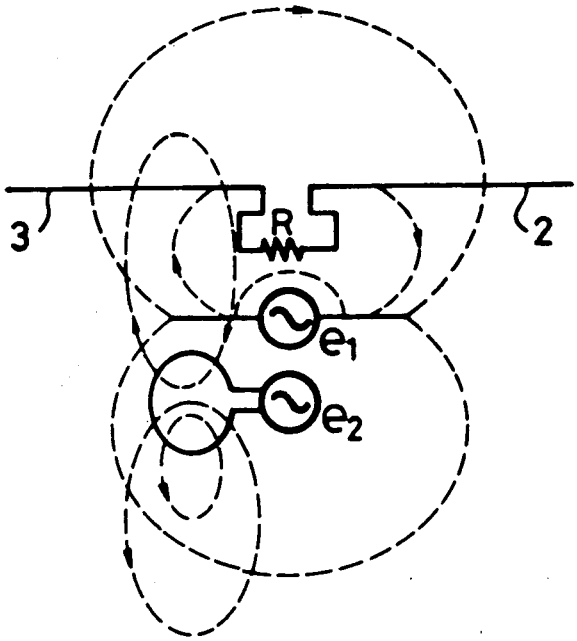
FIG. 3 (PRIOR ART)
FIG. 3 is a schematic diagram of the distribution of electromagnetic fields of the equivalent circuit shown in FIG. 2.

The earth pattern 14 includes a disturbing source e ($e = e_1' + e_2' + e_3'$) and the displacement current from the earth pattern 14 tends to flow through the balun 13 to the antenna 11 and the conductor 12. In this case, however, the impedances between the terminals S and E and between the terminals P and F of the balun 13 for the common mode (equiphase component) are high so that the disturbing displacement current is prevented from flowing to the antenna 11 and the shielding conductor 12, thus making it possible to prevent beat interference in the television picture and beat interference in an audio signal. More specifically, in the case of FIG. 7, the disturbing currents which are induced in the earth pattern 14 by the disturbing signal sources $e_1$, $e_2$ and $e_3$ are blocked by the balun 13 so that the beat interferences are considerably attenuated as compared with the prior art device shown in FIG. 1. The balun 13, however, cannot block the disturbing current i which is directly induced in the shield conductor 12 by the disturbing signal sources $e_1$ and $e_2$ as can be seen in the electromagnetic field shown in FIG. 10.

Figure 11:
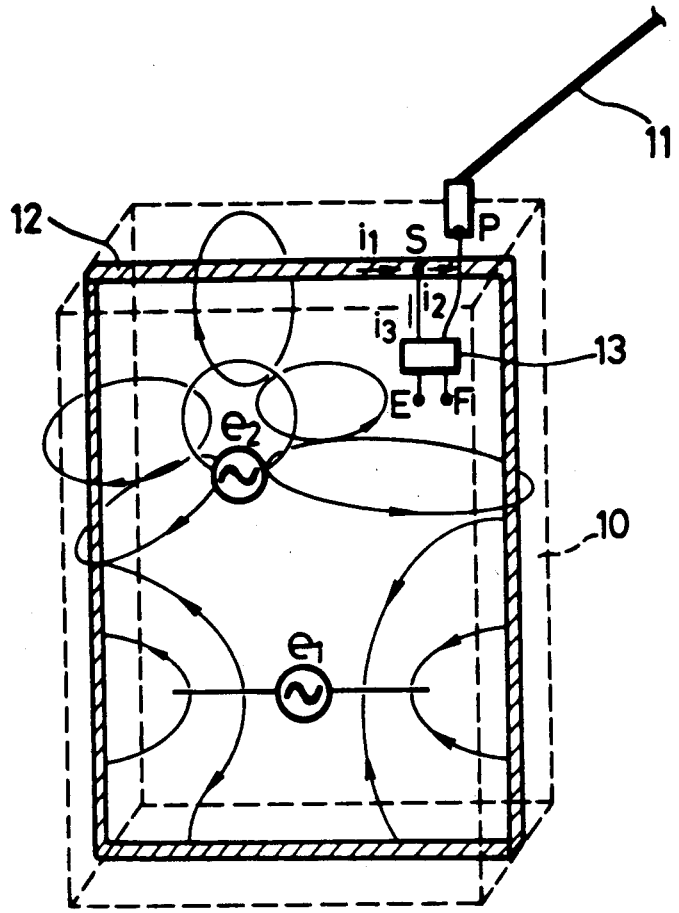

In the case of the device of FIG. 8, the electromagnetic fields which are coupled to the loop-shaped shield conductor 6 are distributed as shown in FIG. 11 so that the direction of the electromotive force at a point S on the loop have many components which are opposite in direction. Accordingly, assuming that $i_1$ and $i_2$ represent disturbing currents flowing to the right and to the left relative to point S, then a current $i_3$ which substantially is a disturbing current is represented by $i_1-i_2$. Thus, the beat interference can be reduced even more than in the FIG. 7 device (or the FIG. 10 device). Further, with the above-mentioned arrangement, a radio wave of a desired signal is not attenuated and the size of the antenna is increased by the area of the loop, which results in an increased sensitivity and broader band response. Furthermore, if a proper impedance is provided for the loop, then it is possible to adjust the current $i_3$ so that it will be minimum and also to adjust the signal-to-noise ratio (S/N ratio) so that it will be maximum.

Figure 12:
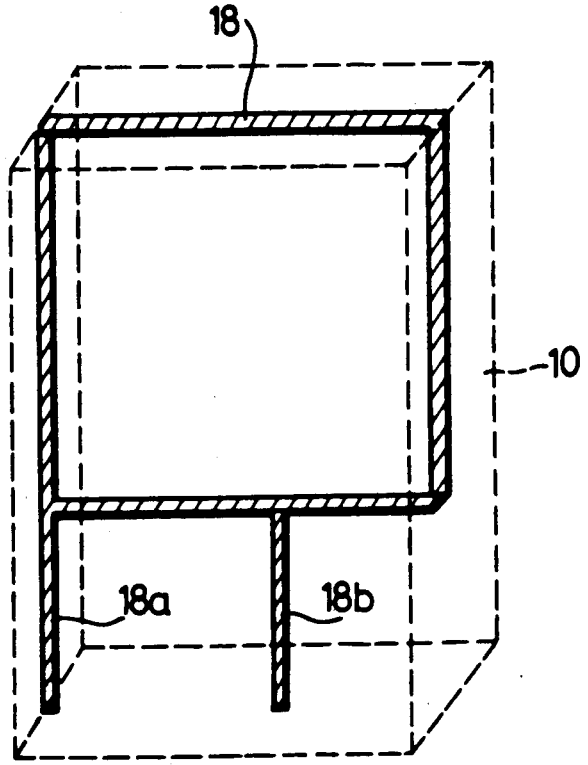
FIG. 12 is a schematic diagram showing a further embodiment of a signal receiver according to the present invention.

FIG. 12 shows a third embodiment of a signal receiver according to the present invention. In this embodiment, the loop-shaped planar shielding conductor 16 used in FIG. 8 is replaced with a loop-shaped planar shielding conductor 18 which has ends which extends downwardly as extensions 18*a* and 18*b* as shown. With the employment of the conductor 18, the antenna effect can be further increased.

Figure 4:
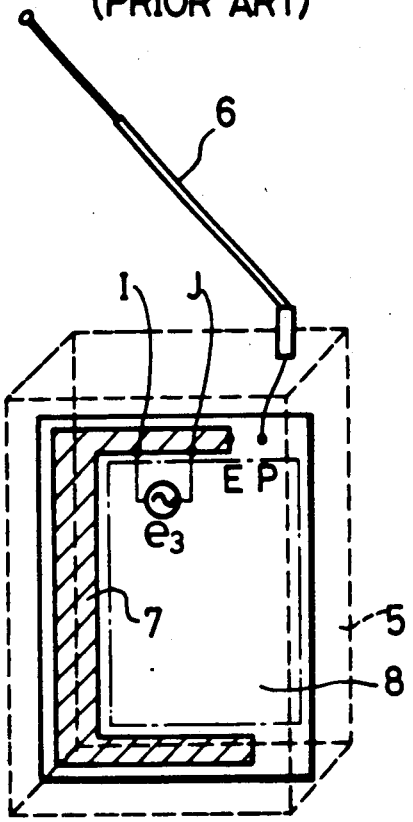
FIG. 4 (PRIOR ART)
FIG. 4 is a schematic diagram showing an example of a prior-art mono-pole antenna type signal receiver.
Figure 6:
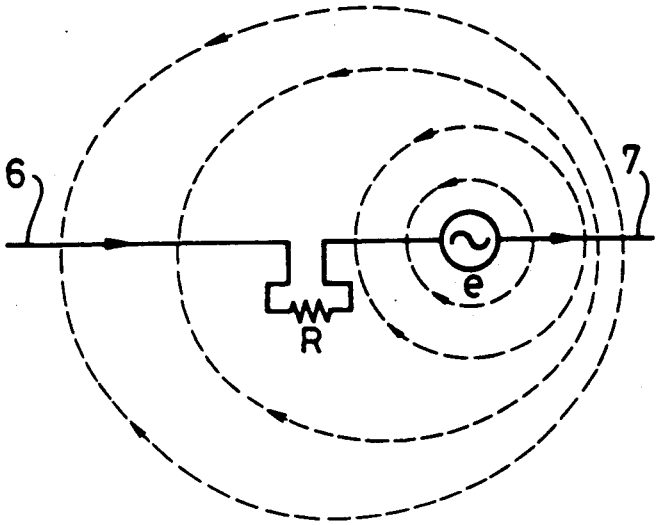
FIG. 6 (PRIOR ART)
FIG. 6 is a diagram of the electromotive force of a disturbing electric field for the circuits shown in FIGS. 5A to 5C.
Figure 5A:
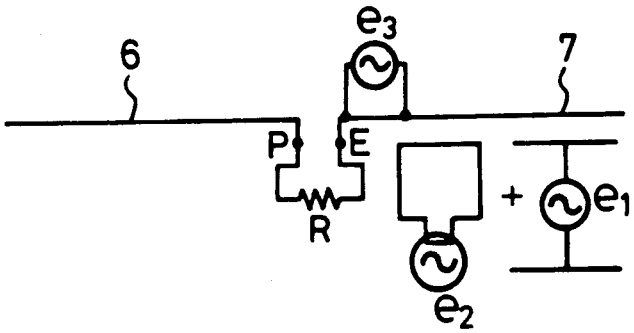
FIG. 5A (PRIOR ART)
FIGS. 5A to 5C are schematic diagrams of the equivalent circuits shown in FIG. 4.
Figure 5B:
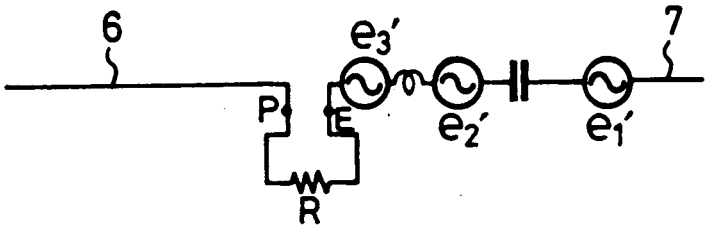
FIG. 5B (PRIOR ART)
Figure 5C:
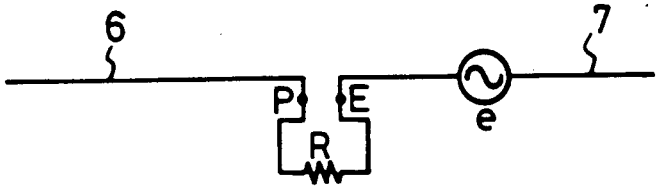
FIG. 5C (PRIOR ART)
Figure 13:
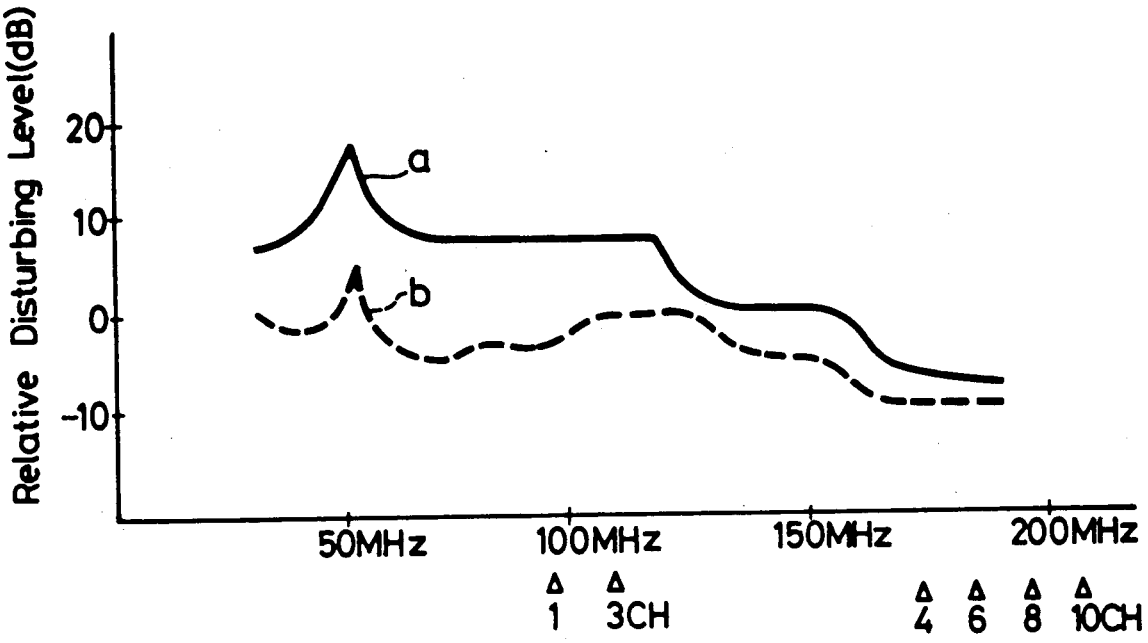
FIG. 13 is a graph showing the disturbing characteristics of the signal receiver of the invention and of the prior-art signal receiver as compared with each other.

FIG. 13 is a graph of the relative disturbance level in which a disturbance level of the tuner of the prior-art signal receiver and a disturbance level of the tuner of the signal receiver according to the present invention are compared. In FIG. 13, a solid line curve a shows the measured results of the disturbance level of the device of FIG. 4 and a broken line curve b shows the measured results of the disturbance level of the device FIG. 8.

From FIG. 13, it is thus apparent that the present invention reduces the disturbance level as compared with the prior art and the present invention achieves a large effect, in particular, in the lower channels such as the first and third channels of a television receiver. It is to be noted that the signal receiver of the present invention is also effective for the lower numbered channels of television receivers in the United States as well as in European countries.

Figure 14A:
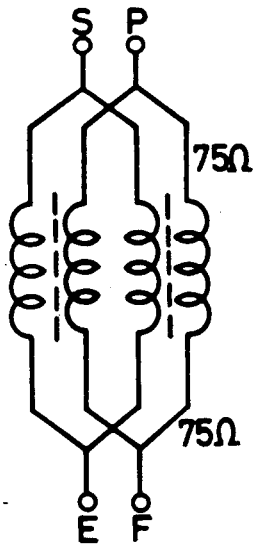
FIGS. 14A and 14B are schematic diagram showing examples of baluns which are used in the present invention.
Figure 14B:
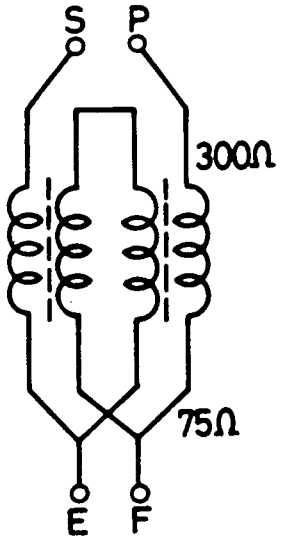

FIG. 14 illustrates examples of balanced-line type baluns 13, wherein FIG. 14A an example of 7Ω75Ω type balun is shown and in FIG. 14B an example of 300Ω75Ω type balun 13 is shown.

Although the signal receiver of the present invention can be applied to a small-sized television receiver (the display panel may be a cathode ray tube or a liquid crystal panel) as described above, the present invention is not limited to the above-mentioned small-sized television receiver and it may be applied to, for example, an FM radio receiver, a cordless telephone, a small-sized television receiver which has a built-in video tape recorder, a compact disc player which has built-in FM radio receiver and so on.

As set out above, according to the present invention, since the shielding conductor is insulated for high frequency from the earth pattern of the circuit which is provided inside of the cabinet as one antenna element so as to form a pair antenna with the mono-pole antenna and the shielding conductor and the output of the mono-pole antenna are connected through the balun to the tuner, and the beat interference in the television picture and the beat interference in the audio signal caused by disturbing signal sources can be eliminated.

It is also possible to prevent the system from malfunctioning such as when synchronization disappears.

Having described preferred embodiments of the invention with reference to the accompanying drawings, it is to be understood that the invention is not to be so limited to those precise embodiments, and that various changes and modifications may be effected therein by one skilled in the art without departing from the scope or spirit of the invention as defined in the appended claims.

I claim as my invention:

1. A signal receiver comprising:

(a) a cabinet;

(b) a mono-pole antenna mounted outside of said cabinet;

(c) a signal receiving apparatus which includes a tuner mounted inside of said cabinet; said signal receiving apparatus having a high frequency circuit portion which radiates outwardly an undesired high frequency signal;

(d) an earth pattern mounted inside of said cabinet and electrically connected to said signal receiving apparatus, (e) a planar shielding conductor mounted inside of said cabinet which surrounds said high frequency circuit portion;

(f) a balun which has first and second input terminals and a pair of output terminals;

(g) first circuit means which connects said mono-pole antenna to said first input terminal of said balun (h) second circuit means which connects one of said pair of output terminals of said balun to said signal receiving apparatus;

(i) third circuit means which connects the other of said pair of output terminals of said balun to said earth pattern, and (j) fourth circuit means which connects said shielding conductor to said second input terminal of said balun such that said shielding conductor operates as an antenna element with said mono-pole antenna element.

2. A signal receiver according to claim 1, wherein said shielding conductor is mounted on the inner surface of said cabinet.

3. A signal receiver according to claim 1, wherein said mono-pole antenna and said shielding conductor form a dipole antenna with said balun.

4. A signal receiver comprising:

(a) a cabinet;

(b) A mono-pole antenna mounted outside of said cabinet;

(c) a signal receiving apparatus which includes a tuner mounted inside of said cabinet; said signal receiving apparatus having a high frequency circuit portion which radiates outwardly an undesired high frequency signal;

(d) an earth pattern mounted inside of said cabinet and electrically connected to said signal receiving apparatus, (e) a planar shielding conductor mounted inside of said cabinet which extends around said high frequency circuit portion of three sides;

(f) a balun which has first and second input terminals and a pair of output terminals;

(g) first circuit means which connects said mono-pole antenna to said first input terminal of said balun (h) second circuit means which connects one of said pair of output terminals of said balun to said signal receiving apparatus;

(i) third circuit means which connects the other of said pair of output terminals of said balun to said earth pattern, and (j) fourth circuit means which connected said shielding conductor to said second input terminal of said balun such that said shielding conductor operates as an antenna element with said mono-pole antenna element.

* * * * *